US010712133B2

(12) United States Patent
Kerley et al.

(10) Patent No.: US 10,712,133 B2
(45) Date of Patent: Jul. 14, 2020

(54) IMPACT INDICATION SYSTEM

(71) Applicant: nTwined LLC, Houston, TX (US)

(72) Inventors: David Kerley, Houston, TX (US); Laurence A. Bay, Atlanta, GA (US)

( * ) Notice: Subject to any disclaimer, the term of this patent is extended or adjusted under 35 U.S.C. 154(b) by 0 days.

(21) Appl. No.: 15/666,195

(22) Filed: Aug. 1, 2017

(65) Prior Publication Data

US 2019/0041172 A1 Feb. 7, 2019

(51) Int. Cl.
*F41J 5/14* (2006.01)
*F41J 5/08* (2006.01)
*F41J 5/056* (2006.01)

(52) U.S. Cl.
CPC ..... *F41J 5/14* (2013.01); *F41J 5/056* (2013.01); *F41J 5/08* (2013.01)

(58) Field of Classification Search
CPC ..... F41J 5/06; F41J 5/02; F41J 5/056; F41J 5/14; F41J 7/04; F41J 5/00; F41J 5/04; F41J 5/41; F41J 1/00; F41J 1/10; F41A 33/00
USPC ..... 340/539.1; 273/371, 372, 396; 235/400
See application file for complete search history.

(56) References Cited

U.S. PATENT DOCUMENTS 3,580,579 A 5/1971 Scharz et al.
3,656,056 A 4/1972 Dalzell, Jr.
3,705,725 A 12/1972 Thalmann
3,854,722 A 12/1974 Öhlund et al.
4,240,640 A 12/1980 LaMura
4,351,026 A * 9/1982 Phillips ..... F41J 5/06 235/400
4,786,058 A 11/1988 Baughman
5,516,113 A 5/1996 Hodge
5,551,876 A * 9/1996 Koresawa ..... F41G 3/2694 434/11
5,575,478 A * 11/1996 Lamberti ..... A63B 69/0097 273/396
5,944,317 A * 8/1999 Rohrbaugh ..... F41J 5/06 235/400
6,367,800 B1 * 4/2002 Sheck ..... F41J 5/056 273/371
7,207,566 B2 4/2007 Hodge
D618,283 S 6/2010 Hodge
9,759,530 B2 * 9/2017 Miller ..... F41J 5/14
2003/0134700 A1 * 7/2003 Salva ..... F41J 5/10 473/476

(Continued)

OTHER PUBLICATIONS

IR.Tools, "Identification for Night Vision and Thermal Imagers," <http://ir.tools/ir-thermal-photoluminescent-technology/> publicly available as early as Mar. 26, 2017.

(Continued)

*Primary Examiner* — Hoi C Lau

(57) ABSTRACT

An impact indication system for indicating an impact of a projectile on a target. The impact indication system includes an impact sensing system including a g-force sensor, a housing engagable with the target, and a first computing device including at least a processor and a memory. The impact indication system further includes a signal output unit including a housing, a signal output device, a second computing device including a processor and a memory, the first computing device operable to send a signal to the second computing device in response to sensing the impact, and the second computing device operable to produce a signal indicative of the impact.

20 Claims, 14 Drawing Sheets

(56) References Cited

U.S. PATENT DOCUMENTS

2005/0275528 A1* 12/2005 Kates ..... G08B 1/08 340/539.22
2007/0160960 A1* 7/2007 Manard ..... F41A 33/00 434/11
2008/0213732 A1* 9/2008 Manard ..... F41A 33/00 434/16
2009/0102129 A1* 4/2009 Isoz ..... F41J 5/056 273/372
2010/0038854 A1* 2/2010 Mraz ..... F41J 5/041 273/371
2012/0074645 A1* 3/2012 Hodge ..... F41J 7/04 273/127 D
2014/0324198 A1* 10/2014 Aubouy ..... F41J 5/00 700/90
2014/0367918 A1* 12/2014 Mason ..... F41J 5/04 273/371
2015/0053107 A1* 2/2015 Sexton ..... F42B 5/03 102/517
2015/0123346 A1* 5/2015 Mason ..... F41J 1/10 273/371
2015/0330749 A1* 11/2015 Miller ..... F41J 5/14 340/539.1
2016/0138895 A1* 5/2016 Beine ..... F41J 5/02 434/19
2016/0313097 A1* 10/2016 Miller ..... F41J 5/14
2016/0370156 A1* 12/2016 Elizondo ..... F41J 5/056

OTHER PUBLICATIONS

IR.Tools, "500' ×2' Thermal Film Rolls for Various Applications and Purposes," <http://ir.tools/products/military-targets-thermal-rolls/> retrieved from the internet Apr. 7, 2017.

IR.Tools, "6 Advantages to Use No Power Targets," http://ir.tools/6-reasons-to-use-no-power-targets/ publicly available as early as May 28, 2016.

Tech Valley Technologies, "Thermal Targets," < http://techvalleytech.com/products/thermal-targets/> publicly available as early as Mar. 12, 2015.

Calienté, "Markets," <https://calientellc.com/markets> publicly available as early as Feb. 7, 2013.

* cited by examiner

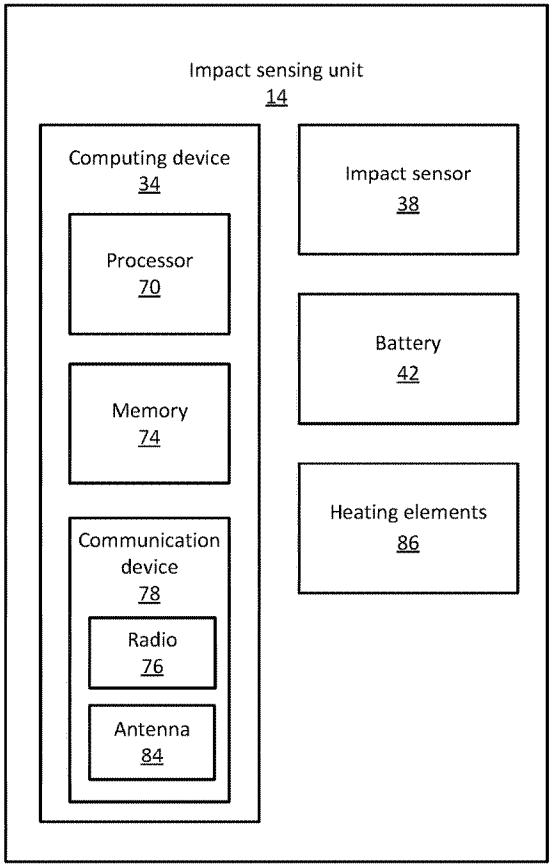
*FIG. 6*
(Amended)
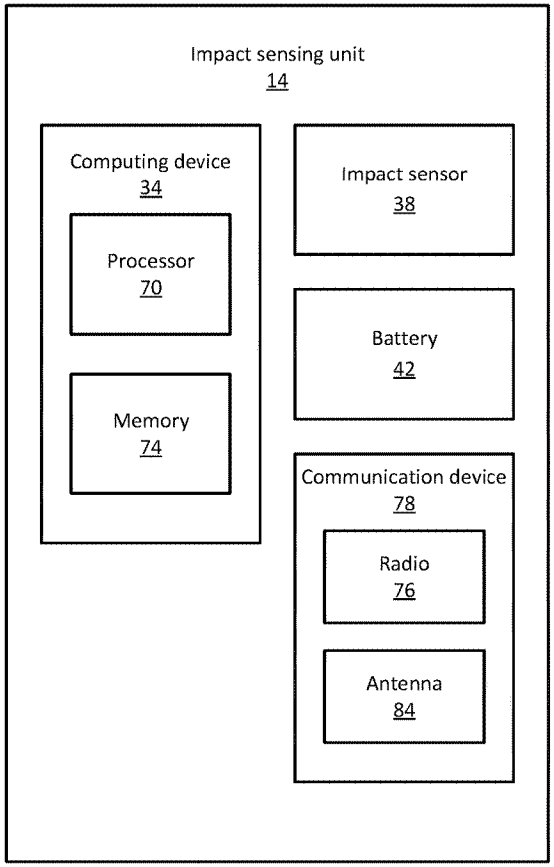
*FIG. 5*
(Amended)

IMPACT INDICATION SYSTEM

BACKGROUND

The present invention relates to an impact indication system for use with a target for a projectile, such as a bullet shot by a firearm.

SUMMARY

In shooting ranges, users shoot bullets or other projectiles at targets. Under some shooting conditions, the targets are located at long distances, sometimes up to 2000 meters or more away from the shooter. Accordingly, it is difficult or impossible for a shooter and/or observers of the shooter to detect an impact of a projectile shot by the shooter on the target. The shooter may rely on human spotters to see the impact and report the impact to the shooter and any observers. An impact may be missed by an inattentive spotter or due to environmental and weather conditions that reduce visibility. Additionally, it may be difficult for the spotter to report the impacts to the shooter quickly.

In one embodiment, the disclosure provides an impact sensing unit engagable with or comprising a portion of a target system and adapted to detect at least an impact of a projectile on the target system. The target system may include a target or a stand holding or supporting the target. The impact sensing unit includes a housing, an impact sensor for sensing an impact along at least a first axis and a second axis, and a computing device including at least one processor and a memory, the computing device in electronic communication with the impact sensor. The memory includes program instructions executable by at least one processor of the computing device to: responsive to sensing the impact, determine whether the impact occurred along the first axis or the second axis, and responsive to determining whether the impact occurred along the first axis or the second axis, determine the energy level sensed by the impact sensor, retrieve a response instruction from the memory based on the axis corresponding to the sensed impact and in some uses a different response instruction based on a combination of the axis and energy level sensed by the impact sensor.

In another embodiment, the disclosure provides an impact indication system for indicating an impact of a projectile on a target. The impact indication system includes an impact sensing unit including a g-force sensor, a housing engagable with the target system, and a first computing device including a least a processor and a memory. The impact indication system further includes a signal unit including a housing, a signal output device, and a second computing device including a processor and a memory, the first computing device operable to send a signal to the second computing device in response to sensing the impact, and the second computing device operable to produce a signal indicative of the impact.

In another embodiment, the disclosure provides an impact indication system for indicating an impact of a projectile on a target. The impact indication system includes an impact sensing system including a g-force sensor, a housing engagable with the target system, and a first computing device including at least a processor and a memory. The impact indication system further includes a signal unit including a housing, a signal output device including a plurality of LEDs, and a second computing device including a processor and a memory. The first computing device is operable to send a first signal indicative of the impact to the second computing device. The second computing device is operable to command the plurality of LEDs to produce a light signal indicative of the impact. In some embodiments, the second computing device may send a second signal indicative of the impact to a third computing device over a network. The second signal may include a time of the impact, an identity of the target system, and other information available to and captured by the impact indication system.

Other aspects of the invention will become apparent by consideration of the detailed description and accompanying drawings.

BRIEF DESCRIPTION OF THE DRAWINGS

FIG. 5 is a schematic representation of an impact sensing unit of the impact sensing system of FIG. 1 according to some embodiments.

FIG. 6 is a schematic representation of an impact sensing unit of the impact sensing system of FIG. 1 according to other embodiments.

DETAILED DESCRIPTION

Figure 1:
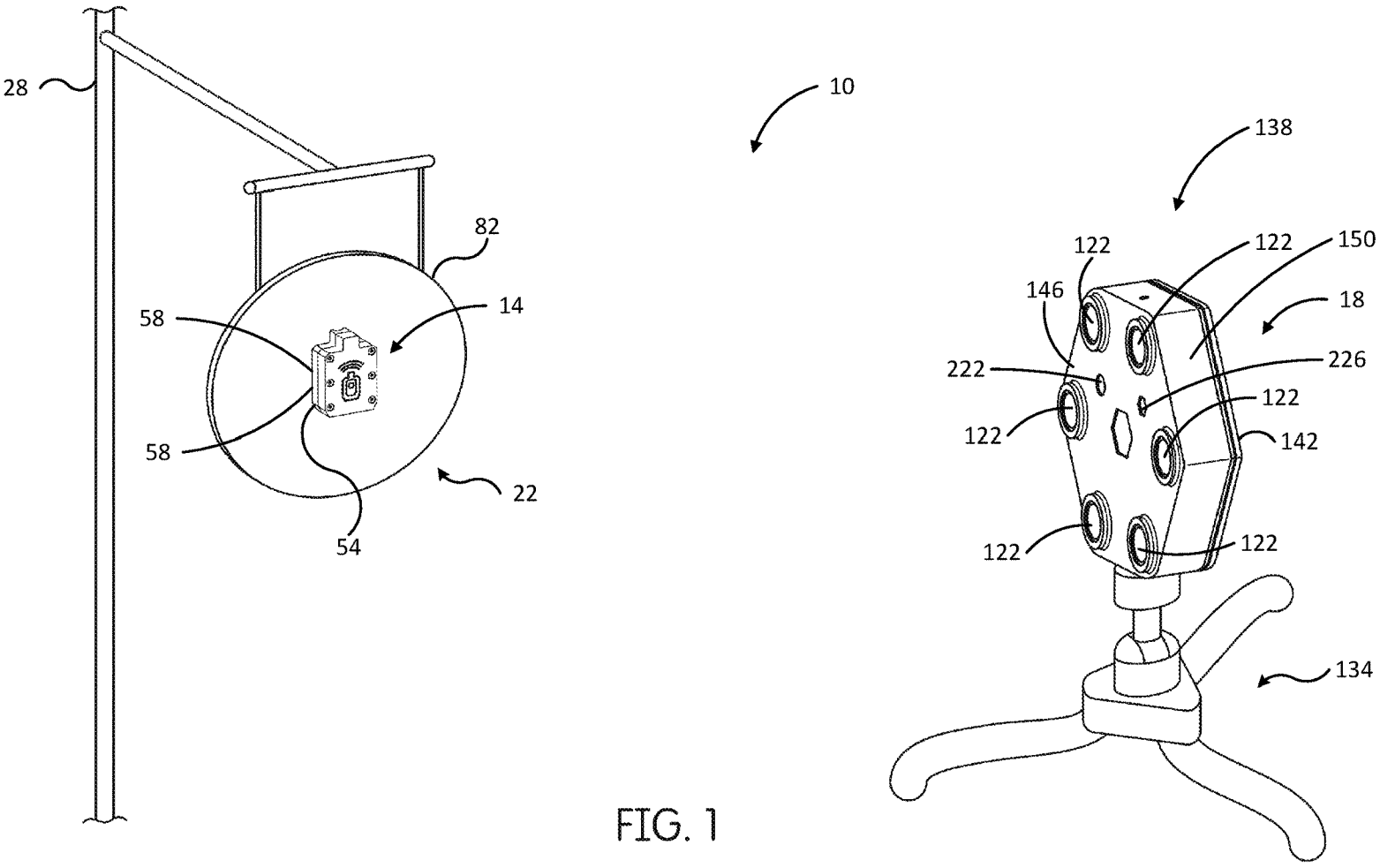
FIG. 1 is a perspective view of an impact indication system according to some embodiments.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. The use of "including", "comprising", or "having" and variations thereof herein is meant to encompass the items listed thereafter and equivalents thereof as well as additional items. As used herein, the word "may" is used in a permissive sense (e.g. meaning having the potential to) rather than the mandatory sense (e.g. meaning must). In any disclosed embodiment, the terms "approximately", "generally", and "about" may be substituted by "within a percentage of" what is specified, where the percentage includes 0.1, 1, 5, and 10 percent.

Some portions of the detailed description which follow are presented in terms of algorithms or symbolic representations of operations on binary digital signals stored within a memory of a specific apparatus or special purpose computing device or platform. In the context of this particular specification, the term specific apparatus or the like includes a general purpose computer once it is programmed to perform particular functions pursuant to instructions from program software. Algorithmic descriptions or symbolic representations are examples of techniques used by those of ordinary skill in the signal processing or related arts to convey the substance of their work to others skilled in the art. An algorithm is here, and is generally, considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared, or otherwise manipulated. It has been proven convenient at times, principally for reasons of common usage, to refer to signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, the terms "processing", "computing", "calculating", "determining" or the like refer to actions or processes of a specific apparatus, such as a special purpose computer or a similar special purpose electronic computing device. In the context of this specification, therefore, a special purpose computer or similar special purpose electronic computing device is capable of manipulating or transforming signals, typically represented as physical electronic or magnetic quantities within memories, registries, or other information storage devices, transmission devices, or display devices of the special purpose computer or similar special purpose electronic computing device. The use of the variable "n" is intended to indicate that a variable number of local computing devices may be in communication with the network.

FIG. 1 illustrates an impact indication system 10 including an impact sensing unit 14 and a signal unit 18. The impact sensing unit 14 is removably coupled to a target system 22 and the signal unit 18 is positioned proximate the target system 22. The target system 22 may include a target surface 82 and an optional stand 28 for supporting the target system 22. The impact sensing unit 14 may be used with different target systems than the target system 22 shown in FIG. 1.

Figure 2:
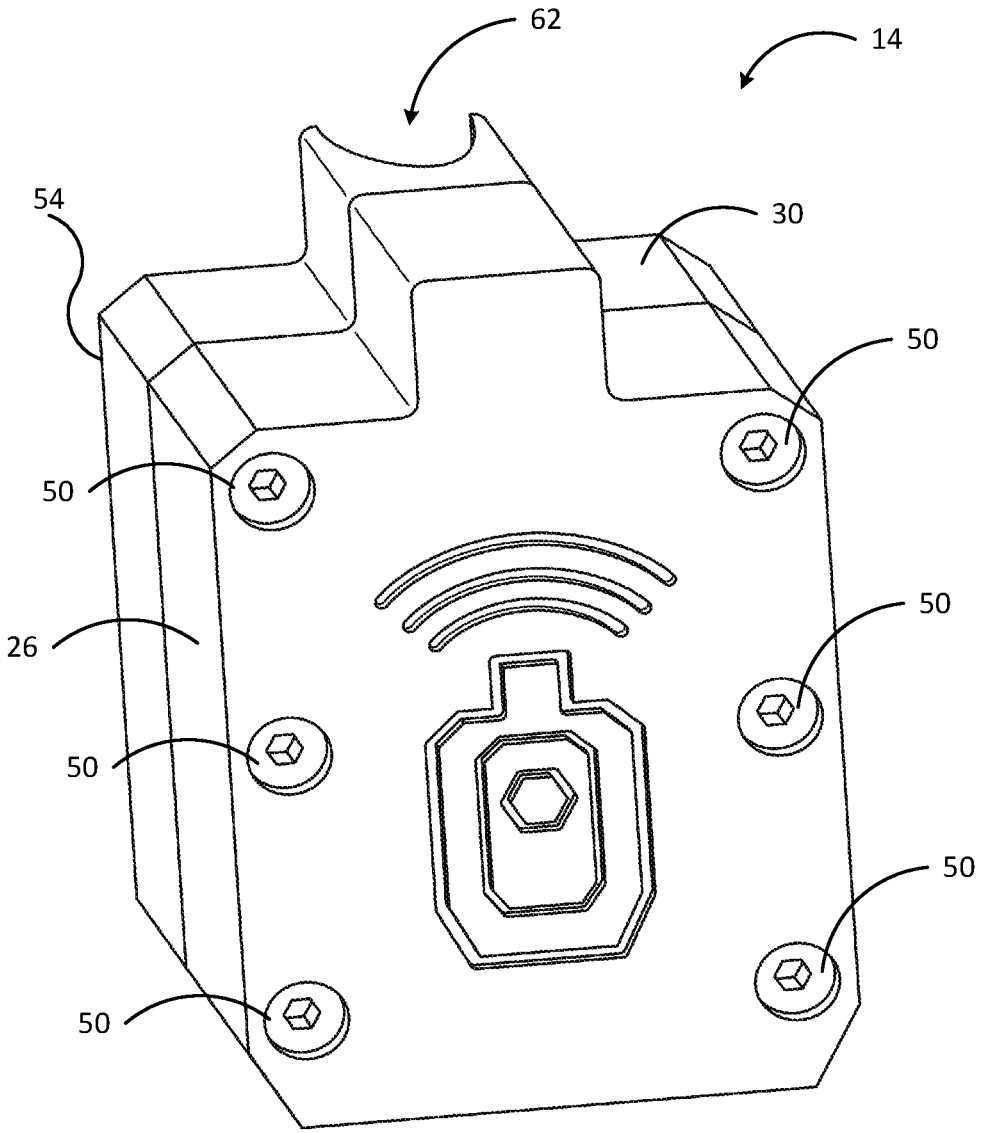
FIG. 2 is a perspective view of an impact sensing unit of the impact sensing system of FIG. 1 according to some embodiments.
Figure 3:
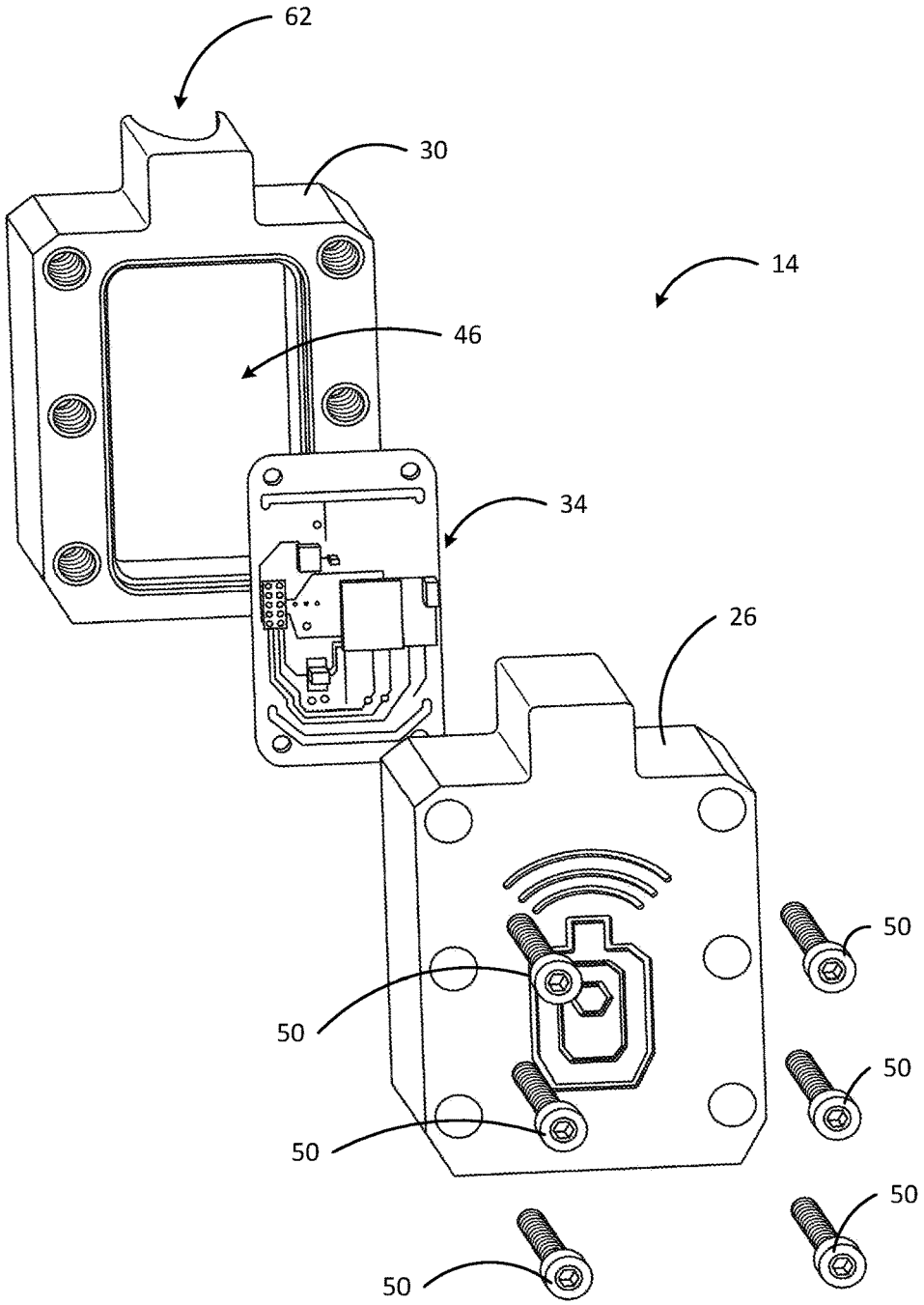
FIG. 3 is an exploded view of the impact sensing unit of FIG. 2.
Figure 4:
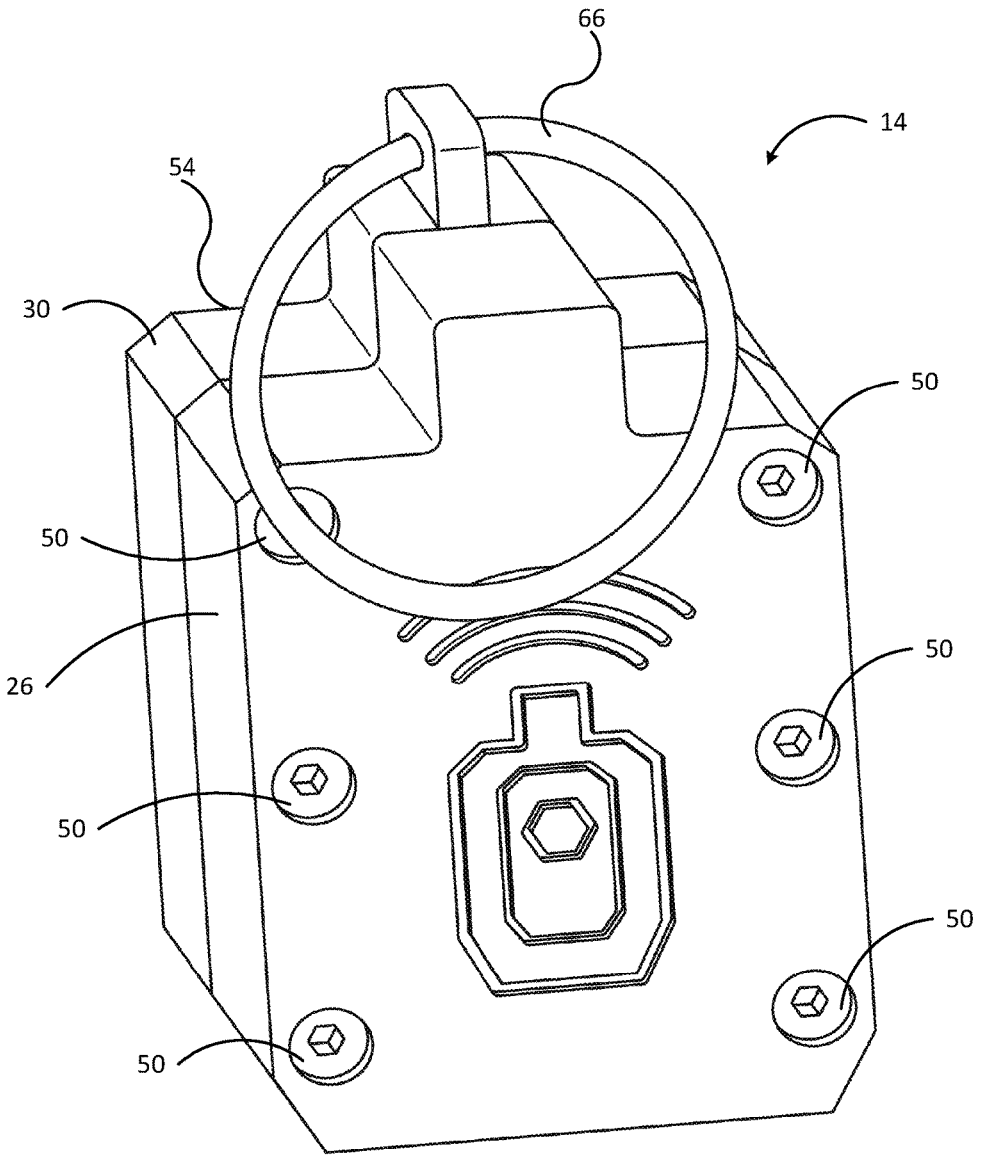
FIG. 4 is a perspective view of an impact sensing unit of the impact sensing system of FIG. 1 according to another embodiment.

With additional reference to FIGS. 2-4, the impact sensing unit 14 includes a front housing portion 26, a back housing portion 30, a circuit board 34, a communication device 78, an impact sensor 38, and at least one battery 42. The front housing portion 26 and the back housing portion 30 cooperatively form a cavity 46 for receiving the impact sensor 38, the circuit board 34, and the battery 42. The front housing portion 26 is secured to the back housing portion 30 by a plurality of fasteners 50. In the illustrated embodiment, the fasteners 50 are threaded fasteners. In alternate embodiments, the fasteners may include friction-fit members, magnets, or any other fastening means conventionally known in the art. A back surface 54 of the back housing portion 30 is securable to a target system 22 in one embodiment as shown in FIG. 1 attached to the target surface 82 by a fastener 58. In other embodiments, impact sensing unit 14, or a physical or functional portion thereof, may be mounted to a target mounting system. Exemplary fasteners may include Velcro, magnets, an adhesive, threaded connectors, or any fastening means conventionally known in the art. An indentation 62 is formed in an upper portion of the back housing portion 30 and extends through a portion of the back surface 54 of the back housing portion 30. The indentation 62 may be adjacent the target surface 82 when the impact sensing unit 14 is attached to the target surface 82. The indentation 62 is graspable by a user to facilitate removing the impact sensing unit 14 from the target surface 82. In other embodiments, the impact sensing unit 14 may include other features for removing the impact sensing unit 14 from the target surface 82. For example as shown in FIG. 4, the impact sensing unit 14 may include a ring 66 engaged with a top portion of the back housing portion 30. In other embodiments the impact sensing unit 14 may be attached to the target system 22 by other common methods.

As shown in FIGS. 5 and 6, the circuit board 34 includes a processor 70, and a memory 74. The circuit board 34 is in electronic communication with the impact sensor 38. The memory 74 includes instructions executable by the processor 70, for example, in response to an impact sensed by the impact sensor 38 as is described in more detail below, or in response to communications received by the communication device 78.

The communication device 78 may include a radio 76 and at least one antenna 84. In the illustrated embodiment, the communication device 78 may be separate from, but in communication with, the computing device. In other embodiments, the circuit board 34 may include the communication device 78 or the communication device 78 may have a processor 70 which is shared by the circuit board 34 and the communication device 78. The communication device 78 is capable of communicating with other impact sensing units 14, signal units 18, and other electronic devices using communication methods such as Bluetooth, radio signals, or wireless internet signals sent over the antenna 84.

In the illustrated embodiment of FIGS. 5 and 6, the impact sensor 38 is a multi-axis G-force impact sensor. In a preferred embodiment, the impact sensor 38 may differentiate between impacts along an X-axis, a Y-axis, and a Z-axis in a positive direction or a negative direction. The impact sensor 38 is adapted to sense both an impact of a projectile, such as a bullet, and impacts associated with user input control. A sensitivity of the impact sensor 38 can be programmed based on the input that is sensed along a particular axis. In some embodiments, energy transferred to the impact sensor 38 along any axis in any direction, for example through a target system 22. In an embodiment, a target surface 82, through a fastener 58, can vary from impact to impact and the impact sensor 38 can detect levels of energy to be communicated to the processor 70. For example, the impact sensor 38 may be configured to sense an impact of a projectile with a strike face of the target surface 82 along the X-axis and the impact sensor 38 may be configured to sense user inputs along the Y-axis and the Z-axis. In some embodiments, the strike face may be a face of target surface 82 located opposite the impact sensing unit 14. In such an embodiment, software instructions in memory 74 would be used by processor 70 in communication with impact sensor 38 to interpret the level of energy and the number and or the frequency sensed by the impact sensor 38 along the Y-axis and the Z-axis and execute different software instructions with impacts of a smaller magnitude than the impacts sensed along the X-axis. In some embodiments, a processor may receive data and initiate different actions based on the data received from the impact sensor, the software instructions stored in a memory associated with the detected impact, or a combination thereof.

The memory 74 may include different instructions executable by the processor 70 in response a sensed impact along a specific axis. For example, in response to sensing an impact on the target surface 82 along the X-axis, the impact sensing unit 14 may send a signal indicative of the impact to the signal unit 18 or other electronic devices over the network 80. In a second example, tapping the impact sensing unit 14 along one of the Y-axis and the Z-axis may turn the impact sensing unit 14 on, turn the impact sensing unit 14 off, put the impact sensing unit 14 into a low energy mode, or indicate a charge status of the battery 42. In a third example, pattern of impacts may be programmed for user input control. For example, one tap on the impact sensing unit 14 may initiate a first instruction executable by the processor 70 or two taps on the impact sensing unit 14 may initiate a second instruction executable by the processor 70. In a fourth example, the impact sensing unit 14 may be adapted for measuring shooter performance in the instance of impacts of projectiles on a target strike face 82 by sensing a number of impacts that occur in a period of time.

In some embodiments, as shown in FIG. 5, the impact sensing unit 14 is made of a material such as aluminum, stainless steel, a durable plastic, or some combination of materials. In other embodiments, as shown in FIG. 6, the impact sensing unit 14 is made of a material such as silicone. In such an embodiment, heating elements 86 may be positioned within at least one of the housing portions 26, 30 or embedded into at least one of the housing portions 26, 30. The heating elements 86 are powered by the battery 42 positioned in the cavity 46 formed between the housing portions 26, 30 of the impact sensor 38. In some embodiments, the heating elements 86 are adapted to heat at least one of the housing portions 26, 30 so that the impact sensing unit 14 may be visible in the infrared (IR) spectrum. In other embodiments, the heating elements 86 include contacts or connectors for establishing electrical communication with heating elements attached to or imbedded in the target surface 82 so that the target system 22 may be visible in the infrared (IR) spectrum. Silicone's ability to retain the heat generated by the heating elements 86 allows relatively small batteries to be used to power the heating elements 86, meaning that the impact sensing unit 14 may be used as a portable thermal target in addition to an impact sensing unit 14.

Figure 7:
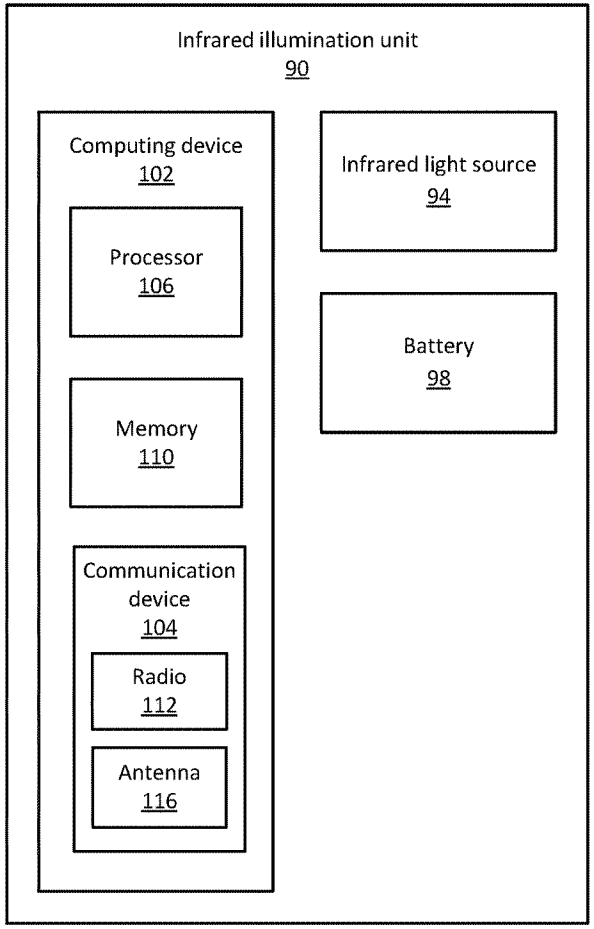
FIG. 7 is a schematic representation of an infrared illumination unit of the impact sensing system of FIG. 1 according to some embodiments.

With reference to FIG. 7, in embodiments of the impact indication system 10 adapted for use in low-light or night-time conditions, the target surface 82 may be formed from a material capable of reflecting IR radiation or be treated with a material that is capable of reflecting IR radiation. In such an embodiment, the impact indication system 10 may also include an IR illumination unit 90 that is positionable in front of and proximate the target surface 82 and operable to illuminate the target surface 82 with IR radiation. The IR illumination unit 90 includes a source of IR radiation 94, a battery 98, and a computing system 102 including a communication device 104, a processor 106 and a memory 110. The communication device 104 may include a radio 112 and an antenna 116. The memory 110 may be programmed with instructions operable by the processor 106 to power the IR source 94 according to a flash pattern. The term "flash pattern" is generally used to refer to a source of IR radiation 94 that is alternately powered on and powered off. In some embodiments, the source of IR radiation 94 is powered on for generally the same amount of time as the source of IR radiation 94 is powered off. In other embodiments, the source of IR radiation 94 is powered on for a longer amount of time than the source of IR radiation 94 is powered off. In other embodiments, the source of IR radiation 94 is powered off for a longer amount of time than the source of IR radiation 94 is powered on. In some embodiments, the flash pattern may be selectable by the operator. In other embodiments, the source of IR radiation 94 may be instructed to turn on or off by actions or activities that occur on other devices on the network. For example, responsive to a sensed impact of a first target surface 82*a*, the processor 106 may execute instructions stored in the memory 110 to command the source of IR radiation 94 for a second target surface 82*b* to be illuminated for a specified period of time. In some embodiments, the IR illumination unit 90 may be adapted to illuminate the target system 22 using light in the visual light spectrum.

Figure 8:
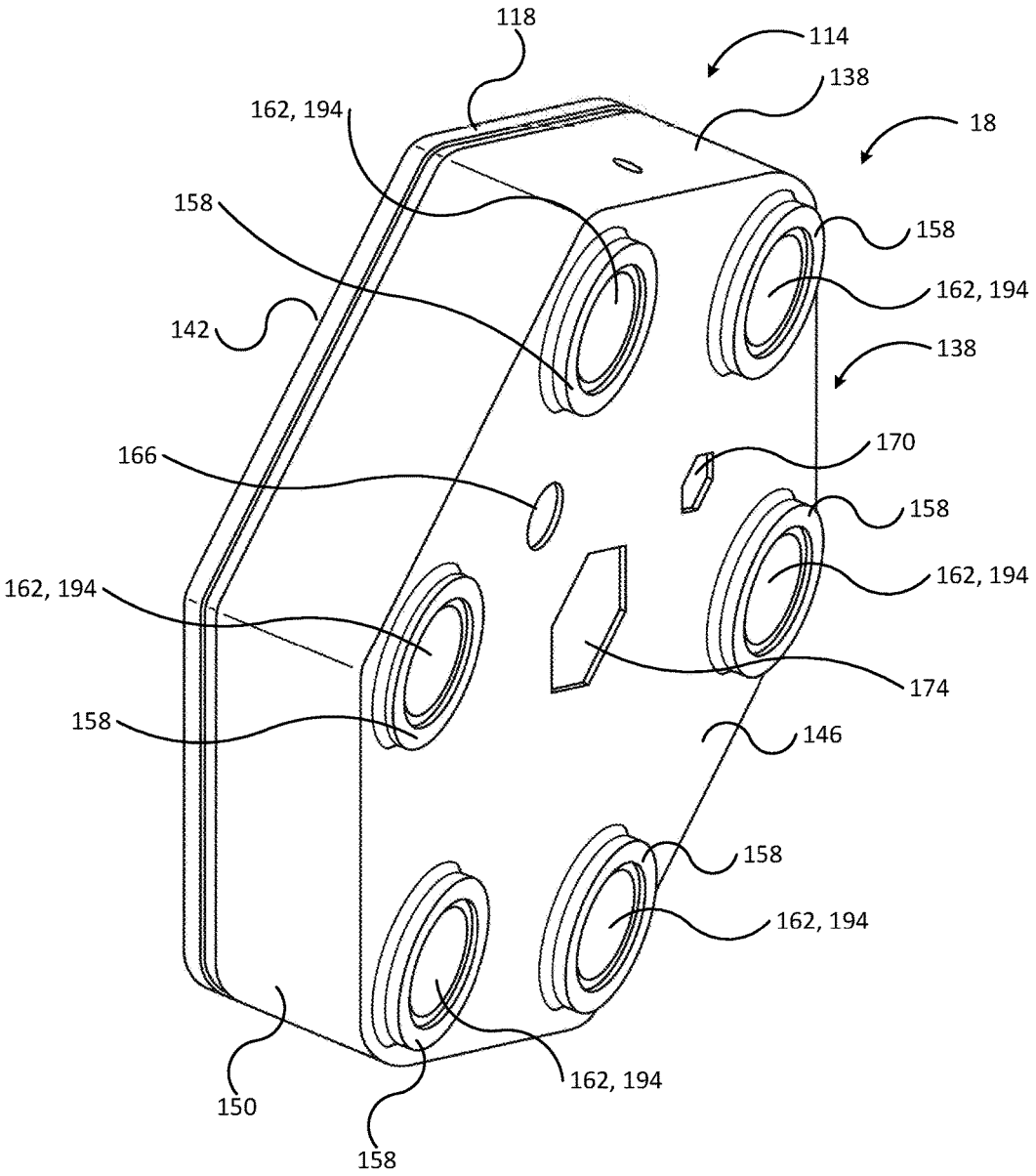
FIG. 8 is a perspective view of a signal unit of the impact sensing system of FIG. 1 according to some embodiments.
Figure 9:
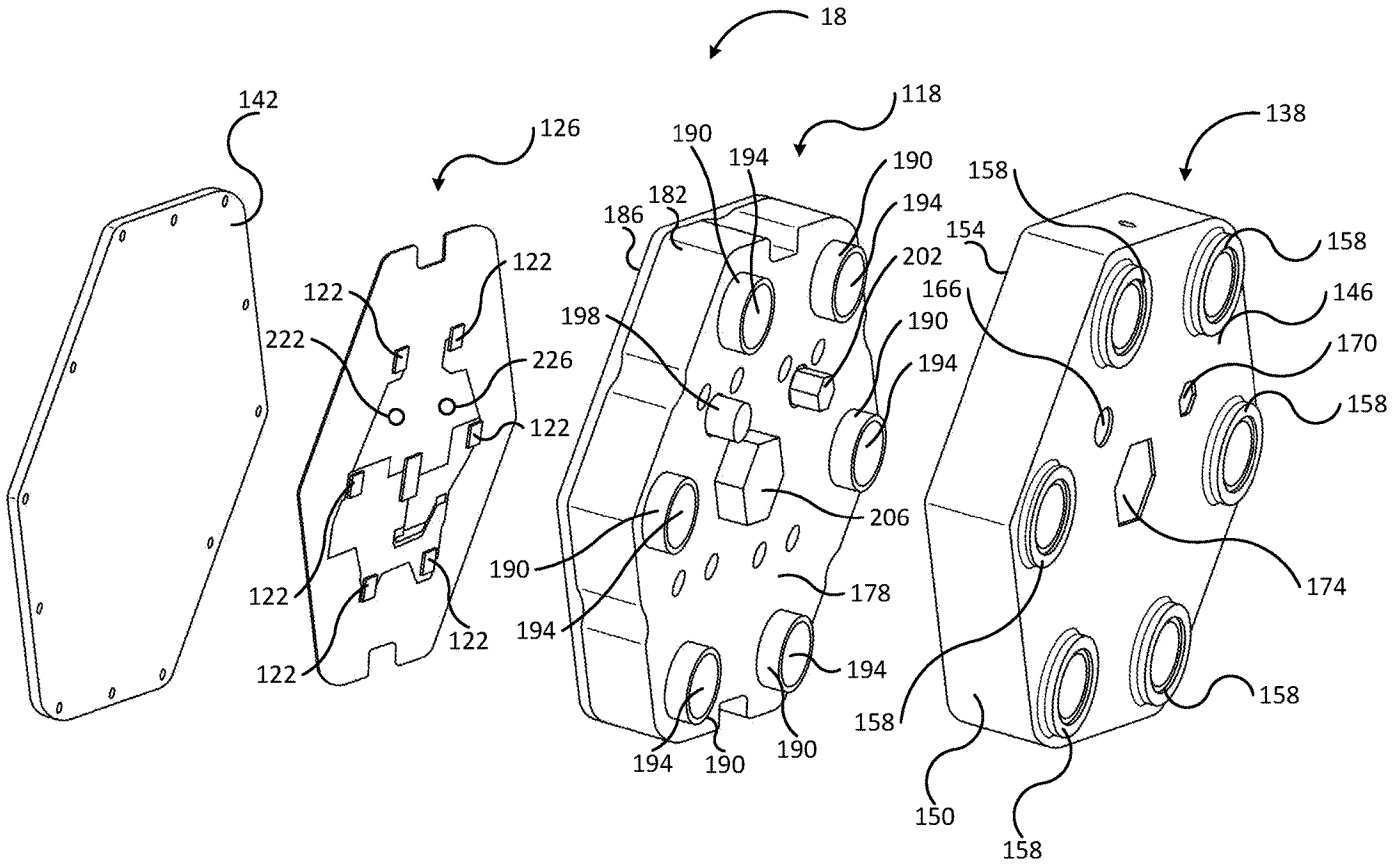
FIG. 9 is an exploded view of the signal unit of FIG. 5.
Figure 10:
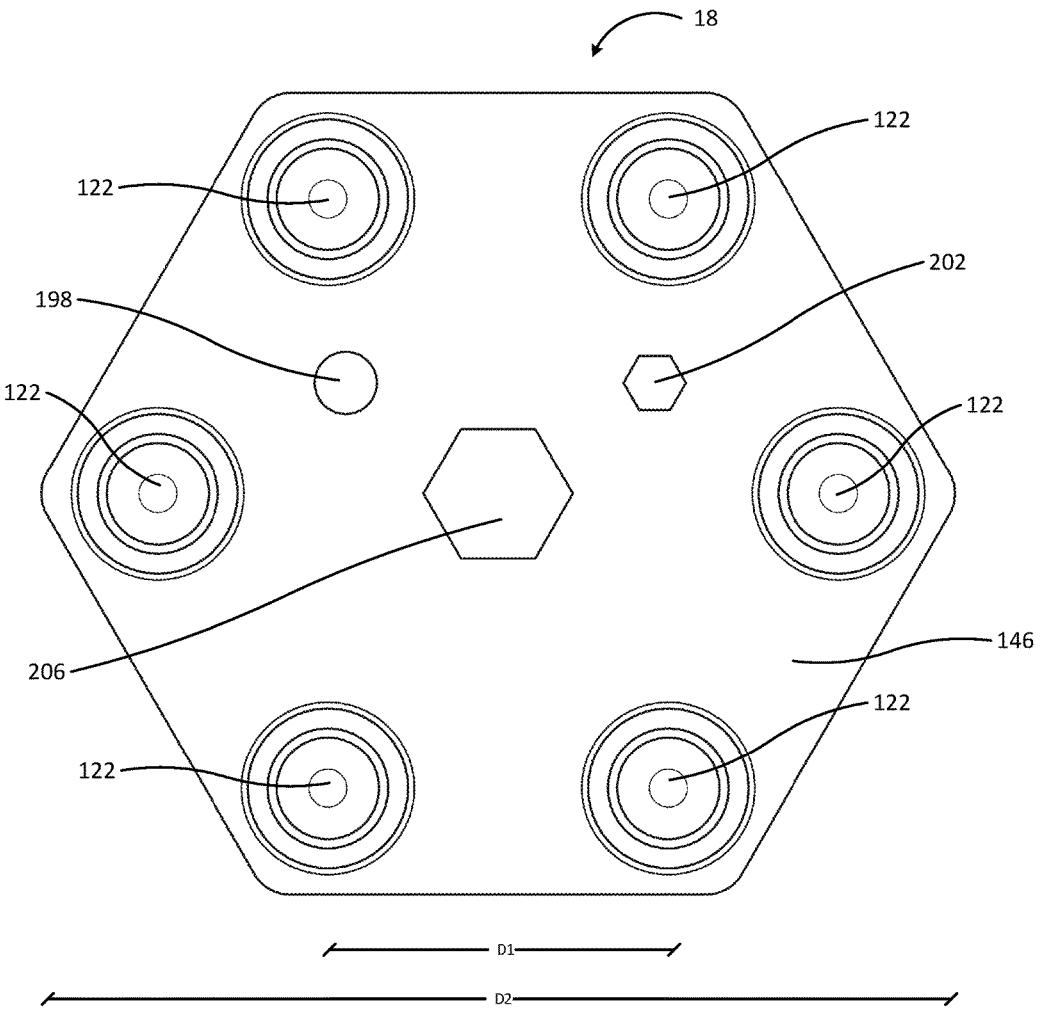
FIG. 10 is a front view of the signal unit of FIG. 5.

With reference to FIGS. 8-10, the signal unit 18 includes a signal unit housing 114, a keypad 118, a signal output device 122, a circuit board 126, a battery 130, and an optional stand 134. The signal unit housing 114 includes a front housing portion 138 and a back housing portion 142. In the illustrated embodiment, the front housing portion 138 is generally hexagonal and includes a front face 146 and a sidewall 150. In other embodiments, the signal unit housing 114 may be a different geometric shape. The front face 146 and the sidewall 150 form a cavity 154 therebetween. The cavity 154 is sized to receive the keypad 118, the signal output device 122, the circuit board 126, and the battery 130. The front face 146 of the front housing portion 138 includes a generally cylindrical protrusion 158 proximate each corner of the front face 146. The term "corner" is used generally to refer to a place at which two converging lines or surfaces intersect. A through-opening 162 is formed in each of the generally cylindrical protrusions 158. The front housing portion 138 also includes a first opening 166, a second opening 170, and a third opening 174. Each of the first opening 166, the second opening 170, and the third opening 174 is sized to receive a portion of the keypad 118 therethrough. In the illustrated embodiment, the first and second openings 166 and 170 are generally circular and the third opening 174 is generally hexagonal. In other embodiments, the openings 166, 170, 174 may have different shapes and be positioned in different locations on the front face 146. In a preferred embodiment, the front housing portion 138 and the back housing portion 142 are made of a material such as aluminum, stainless steel, a durable plastic, or some combination of materials.

As is best shown in FIG. 9, the keypad 118 is generally hexagonal and includes a front surface 178, a sidewall 182 and a plurality of lenses 184. In other embodiments, the keypad 118 may be a different geometric shape. In some embodiments, lenses 184 may be held or captured between a cylindrical protrusion 158 and an o-ring or gasket (not shown) made of rubber or another suitable material. In some embodiments, a lens retaining insert may be included to aid in holding the gasket or the lens itself in place against a lip formed by cylintrical protrusion 158. In some embodiments, the lens retaining insert may be fastened by being threaded into the inside of cylindrical protrusion 158. In various embodiments, lenses 184 may be made of plastic, glass, or another suitable material and may be substantially transparent or tinted according to a specific indication design. The protrusions 158 are adapted to form a seal around the lenses 184 to prevent water, dust, and other materials from entering the cavity 154.

In some embodiments, the front surface 178 and the sidewall 182 form a cavity 186 therebetween. The cavity 186 is sized to receive the signal output devices 122, the circuit board 126, and the battery 130. The front surface 178 includes a hollow, generally cylindrical protrusion 190 proximate each of the corners of the front surface 178. A through-opening 194 is formed in each of the generally cylindrical protrusions 190. Each of the hollow, generally cylindrical protrusions 190 is aligned with one of the cylindrical protrusions 158 of the front housing portion 138. In some embodiments, lenses 184 may instead be positioned within a through opening 194, in a similar fashion as described above with reference to embodiments wherein lenses positioned immediately behind protrusion 158. The protrusions 190 are adapted to form a seal around the lenses 184 to prevent water, dust, and other materials from entering the cavity 154. The front surface 178 also includes a first protrusion 198, a second protrusion 202, and a third protrusion 206. In the illustrated embodiment, the first protrusion 198 extends through the first opening 166 in the front housing portion 138, the second protrusion 202 extends through the second opening 170 in the front housing portion 138, and the third protrusion 206 extends through the third opening 174 in the front housing portion 138. In the illustrated embodiment, the first and second protrusions 198 and 202 are generally circular and the third protrusion 206 is generally hexagonal. In alternate embodiments, the protrusions 198, 202, 206 may have different shapes and be positioned in different locations along the front surface 178 of the keypad 118.

Figure 11:
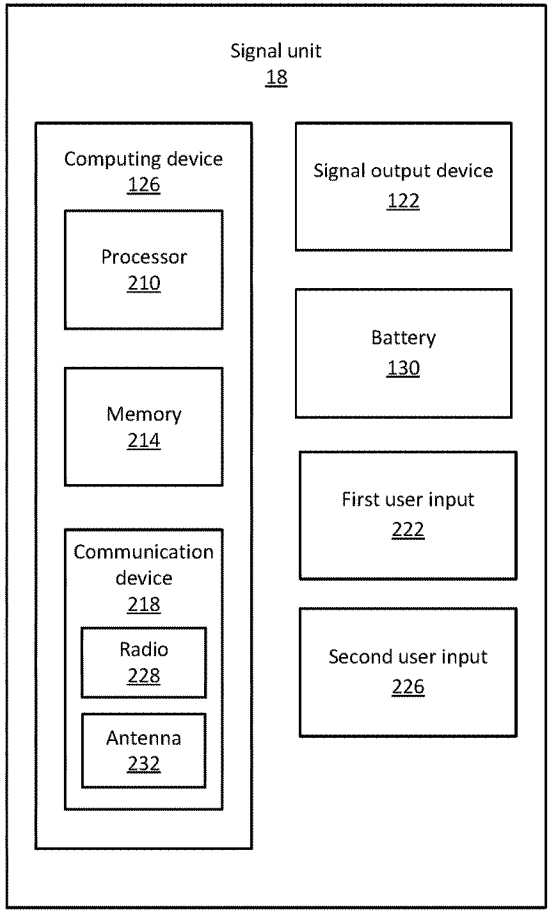
FIG. 11 is a schematic representation of a signal unit of the impact sensing system of FIG. 1 according to some embodiments.

As is best shown in FIG. 11, the circuit board 126 includes a processor 210, a memory 214, a communication device 218, and at least a first user input 222 and a second user input 226. In the illustrated embodiment, the first user input 222 and the second user input 226 are buttons actuable by an operator to input instructions into the circuit board 126. In the illustrated embodiment, the circuit board 126 is in electronic communication with at least one impact sensing unit 14 and is operable to generate a signal in response to an impact sensed by the impact sensing unit 14. In some embodiments, the signal unit 18 may also be in communication with other impact sensing units 14, other signal units 18, and/or a hub computing device 230. The memory 214 may include response instructions based on an input signal received from the first button 222, the second button 226, or from another device on the network 80. In the illustrated embodiment, the first protrusion 198 is aligned with the first button 222 and the second protrusion 202 is aligned with the second button 226. Accordingly, a user may actuate the first button 222 or the second button 226 by pressing the first protrusion 198 or the second protrusion 202, respectfully. The first protrusion 198 and the second protrusion 202 may include markings to indicate a functionality of the buttons 222, 226. In the illustrated embodiment, the first button 222 is an on/off switch and the first protrusion 198 has a color different than a color of the rest of the keypad 118. The second button 226 is a wireless communication on/off switch and includes a symbol indicative of wireless communication. The first button 222, the second button 228, or both the first button 222 and the second button 226 may be used to configure the impact sensing unit 14. By way of non-limiting example, the first button 222, the second button 226, or the first button 222 and the second button 226 may be used to determine a status of the battery 130, control an impact sensitivity along at least one of the X-axis, the Y-axis, and the Z-axis of the impact sensing unit 14, establish electronic communication between the impact sensing unit 14 and the signal unit 18, stop electronic communication between the impact sensing unit 14 and the signal unit 18, or command the impact sensing unit 14 to enter a low power (e.g. sleep) mode.

Alternate embodiments may include different numbers of user inputs and different functionalities of user input. For example, in some embodiments, a user input may be operable to change between a visible signal and an auditory signal output by the signal output device 122, an intensity of the signal output by the signal output device 122, a pattern of a signal output by the signal output device 122, a color of a light signal output by the signal output device 122, or a pitch of a sound signal output by the signal output device 122.

As shown in FIGS. 9 and 11, the communication device 218 may include a radio 228 and an antenna 232. As is best illustrated in FIG. 9, the antenna 232 may be positioned within the third protrusion 206 of the keypad 118. The third protrusion 206 of the keypad 118 is aligned with the third opening 174 of the front housing portion 138. Electronic signals sent to or from the radio 228 or the antenna 232 may pass through the third protrusion 206 of the keypad 118 and the third opening 174.

In some embodiments, the communication device 218 may further include a second antenna (not shown). The second antenna may be positioned on an outer surface of the signal unit housing 114 or may include a portion that protrudes through the signal unit housing 114. In such embodiments, the antenna 232 may be adapted for communication using short range signals and the second antenna may be adapted for communication using long range signals.

In the embodiment illustrated in FIGS. 8-10, the signal output devices 122 are light emitters, such as LEDs, that emit light visible to the human eye. In some embodiments, the light emitted by the signal output devices 122 may be visible by a human positioned up to 1000 yards away from the signal unit 18, up to 1,775 yards away from the signal unit 18, or up to 3000 yards away from the signal unit 18. In some embodiments, the signal output devices 122 emit visible light in the red portion of the visual light spectrum or the blue portion of the visible light spectrum. In alternate embodiments, the signal output devices 122 may output an audio signal or a smoke signal. In some embodiments, the signal output by the signal output device 122 is the same pattern and/or intensity every time the impact sensing unit 14 senses an impact to the target surface 82. In other embodiments, the signal output by the signal output device 122 may be different based on a characteristic of the impact. The term "characteristic of the impact" may refer, for example, to a force of the impact, a location of the impact on a target, frequency of multiple impacts (e.g. a number of impacts that occur in a specific time period), or a sound of the impact on the target. For example, based on the characteristic of the impact, an intensity or a pattern of the signal output by the signal output device 122 may be varied by the processor 70. In some embodiments, data transmitted via the radio may also include a date and time of the impact, an identity of the target system 22, an identity of the impact sensing unit 14, or an identity of the signal output device 122. In other embodiments, such information may be transmitted via the LEDs.

Figure 12:
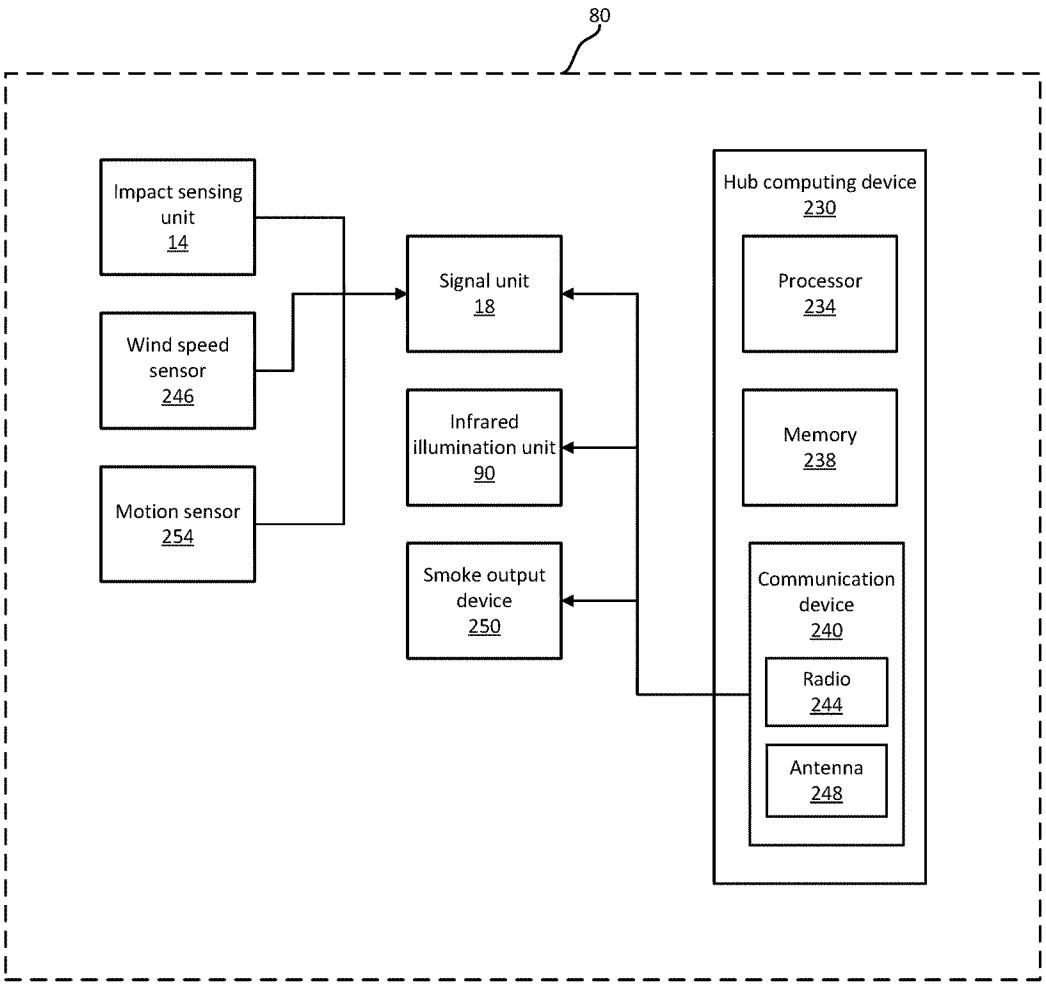
FIG. 12 is a schematic representation of an impact indication system that includes an impact sensing unit, a signal unit, and a hub computing device according to some embodiments.

As illustrated in FIG. 12, in some embodiments, the impact indication system 10 may include a hub computing device 230 including a processor 234, a memory 238, and a communication device 240 in electronic communication with the signal unit 18, the impact sensing unit 14 and/or the IR illumination unit 90. In some embodiments, the communication device includes a radio 244 and an antenna 248. In some embodiments, the hub computing device 230 may be in electronic communication with multiple signal units 18*a*-18*n*, multiple impact sensing units 14*a*-14*n*, and/or multiple IR illumination units 90*a*-90*n* engaged with multiple target systems 22*a*-22*n*. The memory 238 includes instructions executable by the processor 234 to store characteristic information of the sensed impact. In some embodiments, after receiving a communication signal indicative of an impact from one of the impact sensing units 14*a*-14*n*, the hub computing device 230 may add a record of the impact to a competition or training and testing scoreboard or a scoring database. In other embodiments, the hub computing device 230 may analyze the characteristic information about the sensed impacts and execute programmed instructions that control other devices on the network. In other embodiments, the hub computing device 230 may store and analyze the characteristics of multiple signal units 18*a*-18*n*, multiple impact sensing units 14*a*-14*n*, and/or multiple IR illumination units 90*a*-90*n* engaged with multiple target systems 22*a*-22*n*, some characteristics for example may include battery status, location, unique identifier for each.

In some embodiments, the hub computing device 230, the impact sensing units 14*a*-14*n*, and the signal units 18*a*-18*n* may be in electronic communication using short-range radio signals such as Bluetooth signals ZigBee, or 6LoWPAN, wireless internet communication signals, or other communication signals. In other embodiments, the impact sensing units 14*a*-14*n* may be in electronic communication with the signal units 18*a*-18*n* via the short-range radio signal, and the signal units 18*a*-18*n* may be in electronic communication with the hub, circuit board 34, or other network devices via a long range signal, such as a radio signal (WiFi, WiMAX, UHF, VHF, 3G, 4G, FRS/GMRS, etc.). In other communications, the networked devices of the impact indication system may communicate using analog or digital wired communication methods such as ethernet, RS232, and fiber optics.

The memory 238 of the hub computing device 230 may include operating instructions for various operating modes. For example, responsive to receiving the impact signal from a first signal unit 18*a*, the hub computing device 230 may send a command signal to a second signal unit 18*b* to produce an output signal. The output signal may indicate to an operator that a second target surface 82*b* proximate the second signal unit 18*b* is the next target to shoot. In other embodiments, the hub computing device 230 may command the signal units 18*a*-18*n* to change a pattern of a visual impact indication signal, to change a pitch of an audio impact indication system, to trigger a smoke emitting device, or activate a machine controller such as a motorized, pneumatic or robotic target system.

In embodiments in which the IR illumination unit 90 is used, the hub computing device 230 may be in electronic communication with the IR illumination unit 90. In such an embodiment, the hub computing device 230 may command the IR illumination unit 90 to illuminate the target surface 82 according to a specific pattern by direct electronic communications to the IR illumination unit 90 or by commanding the signal unit 18 to communicate with the IR illumination unit 90. The operator may input pattern combinations executable by the IR illumination unit 90 into the hub computing device 230 or into the signal unit 18, which may also be in electronic communications with the IR illumination unit 90. The operator may also select specific patterns executable by the IR illumination unit 90 using the hub computing device 230.

In some embodiments, on or more environmental sensors may be positioned proximate the target system 22. An example environmental sensor according to some embodiments may include a wind speed sensor 246 operable to sense a wind speed proximate the target system 22. The wind speed sensor 246 may be in electronic communication with the hub computing device 230 or the signal output device 122 to communicate the sensed wind speed to a shooter. In other embodiments, a smoke output device 250 may be used to emit a smoke signal in response to a command from the hub computing device 230. The smoke signal is adapted to be visible to a shooter to indicate a direction of the wind to the shooter, to obscure a target, or to attempt to distract a shooter for competitive or training reasons.

In some embodiments, an example environmental sensor may be a motion sensor 254 positioned proximate the target system 22 or the signal unit 18. The motion sensor 254 also may be used independently of the target system 22. In some embodiments, the motion sensor 254 may be configured to detect motion indicative of a person proximate the target system 22. In such an embodiment, the motion sensor 254 is configured to send a communication signal to the signal unit 18. In response, the signal unit 18 sends a warning signal to warn shooters that a human is proximate the target system 22. The warning signal may be a color of light, a pitch of sound, or a pattern of light or of sound. In other embodiments, the motion sensor 254 is configured to detect motion indicative of a game animal. In such an embodiment, the motion sensor 254 is configured to send a communication signal to the signal unit 18. In response, the signal unit 18 sends a game alert signal to alert the shooter that a game animal is proximate the signal unit 18. The game alert signal may be a color of light, a pitch of sound, or a pattern of light or of sound.

In operation, an operator cleans a back of the target surface 82 or a portion of the target system 22 and secures the impact sensing unit 14 to the back of the target surface 82 or the portion of the target system 22 using the fastener 58. The user then applies impacts to the impact sensing unit 14 along at least one of the Y- and Z-axes to command the impact sensing unit 14 to turn on. The user may also apply impacts along at least one of the Y- and Z-axes to set operating parameters of the impact sensing unit 14. For example, if the impact sensing unit 14 includes the heating elements 86, the operator may apply an impact along the Y-axis or the Z-axis to turn the heating elements 86 on or off. The user then positions the signal unit 18 behind and spaced from the impact sensing unit 14. The user may position the signal unit 18 using the stand 134. If the impact indication system 10 is used in low-light conditions, the user then positions the IR illumination unit 90 in front of and spaced from the target system 22. The user actuates the IR illumination unit 90 to shine an IR light onto the strike face 82 of the target system 22.

A shooter then stands a predetermined distance away from the target system 22 and shoots a projectile towards the target system 22. If the impact sensing unit 14 senses an impact of the projectile against or through the strike face 82 of the target surface 82 along the X-axis, the impact sensing unit 14 sends an impact signal to the signal unit 18. In response to receiving the impact signal from the impact sensing unit 14, the signal output device 122 of the signal unit 18 produces an audio or a visual signal indicative of the impact to the shooter. In embodiments in which the impact indication system 10 includes the hub computing device 230, the signal unit 18 may send an impact signal to the hub computing device 230. The hub computing device 230 may store a record of the impact in the memory 238 or add the record of the impact to a scoreboard or a scoring database.

Some embodiments may include multiple impact sensing units 14*a*-14*n* engaged with multiple targets 24*a*-24*n* and multiple signal units 18*a*-18*n* positioned proximate the targets 24*a*-24*n*. In such embodiments, the impact sensing units 14*a*-14*n* and the signal units 18*a*-18*n* are positioned as described above. A shooter may stand within a shooting distance of multiple target systems 22*a*-22*n*. The shooter may shoot a projectile at a first target 24*a*. If the projectile hits the first target 24*a*, the impact sensing unit 14*a* sends an impact signal to a first signal unit 18*a*. The first signal output device 122*a* of the first signal output unit 18*a* produces a first output signal and the first signal unit 18*a* sends an impact signal to the hub computing device 230. After receiving the first impact signal from the first signal unit 18*a*, the hub computing device 230 sends a communication signal to a second signal unit 18*b* proximate a second target surface 82*b* to indicate to the shooter that the shooter should now shoot at the second target surface 82*b*.

Figure 13:
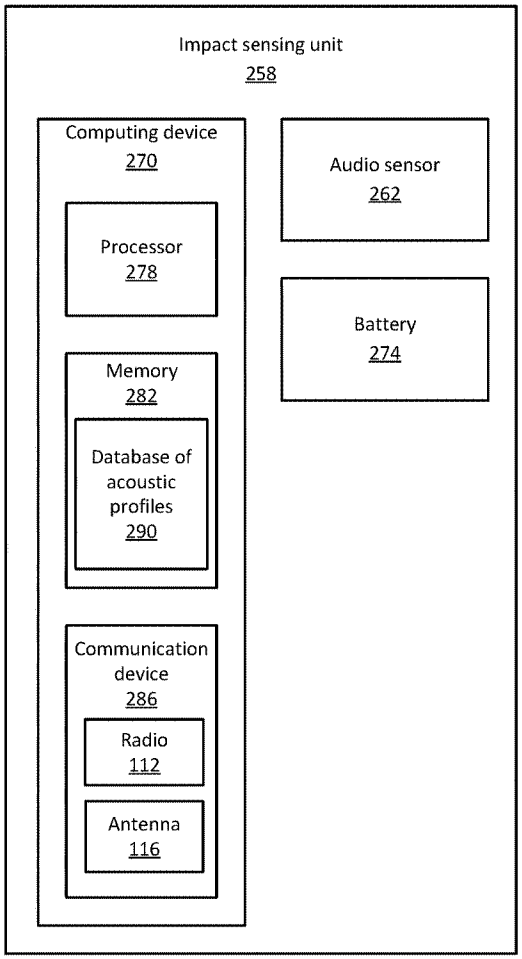
FIG. 13 illustrates a schematic representation of an impact sensing unit of the impact sensing system of FIG. 1 according to some embodiments.

FIG. 13 illustrates an alternate impact sensing unit 258 for use with the impact indication system 10. In some embodiments, the impact sensing unit 258 is used in the impact indication system 10 instead of the impact sensing unit 14. In other embodiments, the impact sensing unit 258 and the impact sensing unit 14 may both be used in the impact indication system 10.

With continued reference to FIG. 13, the impact sensing unit 258 includes an audio sensor 262, a housing 266, a computing system 270, and a battery 274. The audio sensor 262, the computing system 270, and the battery 274 are received within the housing 266. The computing system 270 includes a processor 236, a memory 282, and a communication device 286. The communication device 286 is in electronic communication with the signal unit 18 as described above with respect to the impact sensing unit 14. In some embodiments, the impact sensing unit 258 may also be in electronic communication with the hub computing device 230 as described above with respect to the impact sensing unit 14.

The audio sensor 262 is adapted to sense an acoustic profile of a projectile shot by a shooter. The memory 282 includes a database of acoustic profiles 290 corresponding to hits of a projectile against targets 24*a*-24*n* made of different materials and the acoustic profile of a projectile that misses the target surface 82. For example, the database of acoustic profiles 290 may include the acoustic profile of a bullet hitting a steel target 22 and the sonic crack made by a bullet that passed the impact sensing unit 258 without hitting the target surface 82. The memory 282 includes response instructions executable by processor 278 in response to the acoustic profile 290 sensed by the audio sensor 262. If the computing system 270 determines that the acoustic profile 290 sensed by the audio sensor 262 is indicative of an impact to the target surface 82, the communication device 286 of the computing system 270 sends an impact signal to the signal unit 18. In response to receiving the impact signal, the signal output device 122 of the signal unit 18 produces an output signal to indicate the impact to the shooter. If the computing system 270 determines that the acoustic profile 290 sensed by the audio sensor 262 is not indicative of an impact to the target surface 82, the communication device 286 does not send an impact indication signal to the signal unit 18.

The impact sensing unit 258 may be used in embodiments of the impact indication system 10 that include hub computing devices 230 as described above for the impact indication system 10 that includes the impact sensing unit 14. The impact sensing unit 258 may also be used in in embodiments of the impact indication system 10 that include multiple impact sensing units 258*a*-258*n* positioned proximate multiple target systems 22*a*-22*n* positioned proximate multiple signal units 18*a*-18*n* as described above for embodiments of the impact indication system 10 that include the impact sensing unit 14.

Figure 14:
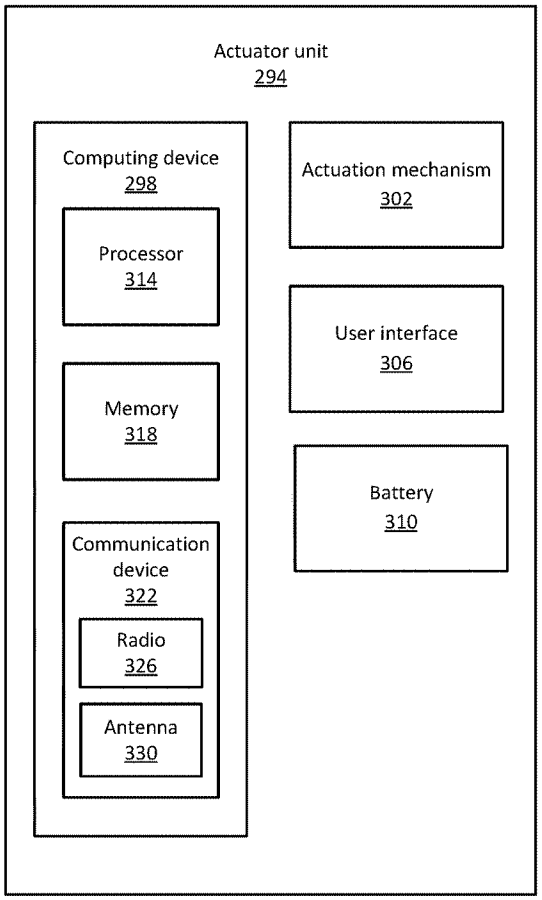
FIG. 14 illustrates a schematic representation of an actuation unit of the impact indication system of FIG. 1 according to some embodiments.

With reference to FIG. 14, in some embodiments, the impact indication system 10 may include an actuator unit 294. The actuator unit 294 includes an actuator unit housing (not shown), a computing device 298, an actuation mechanism 302, a user interface 306, and a battery 310. The actuator unit 294 is engable with the target surface 82 and may be a part of the target system 22. The actuator unit housing is sized to receive the computing device 298, the battery 310, and at least a portion of the actuation mechanism 302 and the user interface 306.

The computing device 298 includes a processor 314, a memory 318, and a communication device 322. The memory 318 includes instructions executable by the processor 314 in response to the impact sensed by the impact sensing unit 14 as is described in more detail below. In some embodiments, the memory 318 may be programmed with movement sequences actuable by the actuation mechanism 302 in response to a sequence of sensed impacts. The communication device 322 may include a radio 326 and at least one antenna 330. In the illustrated embodiment, the communication device 322 may be separate from, but in communication with, the computing device 298. In other embodiments, the computing device 298 may include the communication device 322. The communication device 322 is capable of communicating with impact sensing units 14, signal units 18, IR illumination units 90, hub computing devices 230, and other electronic devices using long or short range communication. For example, in some embodiments, the communication device 322 may receive a short-range signal indicative of an impact from the impact sensing unit 14 and in response may send a long-range signal indicative of the impact sensed by the impact sensing unit 14 to the hub computing device 230 or other devices of the impact indication system 10 in communication over the network 80.

The actuation mechanism 302 is engaged with the target surface 82 and is adapted to reposition the target surface 82, or a portion of the target surface 82 if the target is composed of multiple connected sections, in response to a signal received by the communication device. For example, after receiving a signal indicative of an impact, the actuation mechanism 302 may reposition the target surface 82 in a vertical direction, a horizontal direction, or a both a horizontal or a vertical direction. In a second example, the actuation mechanism 302 may reposition the target surface 82 in response to a signal sent by the IR illumination unit 90. In some embodiments, the actuation mechanism 302 is a pneumatic system. In other embodiments, the actuation mechanism is a motor.

The user interface 306 may be actuable by an operator to input instructions into the actuation mechanism 302. The user interface 306 may be actuable to turn the actuation mechanism on or off, turn wireless communication on or off, determine a status of the battery 310, establish electronic communication between the actuator unit 294 and other devices of the impact indication system 10 communicating over the network 80, stop electronic communication between the actuator unit 294 and other devices of the impact indication system 10 communicating over the network 80, or command the actuator unit 294 to enter a low power (e.g. sleep) mode.

Figure 15:
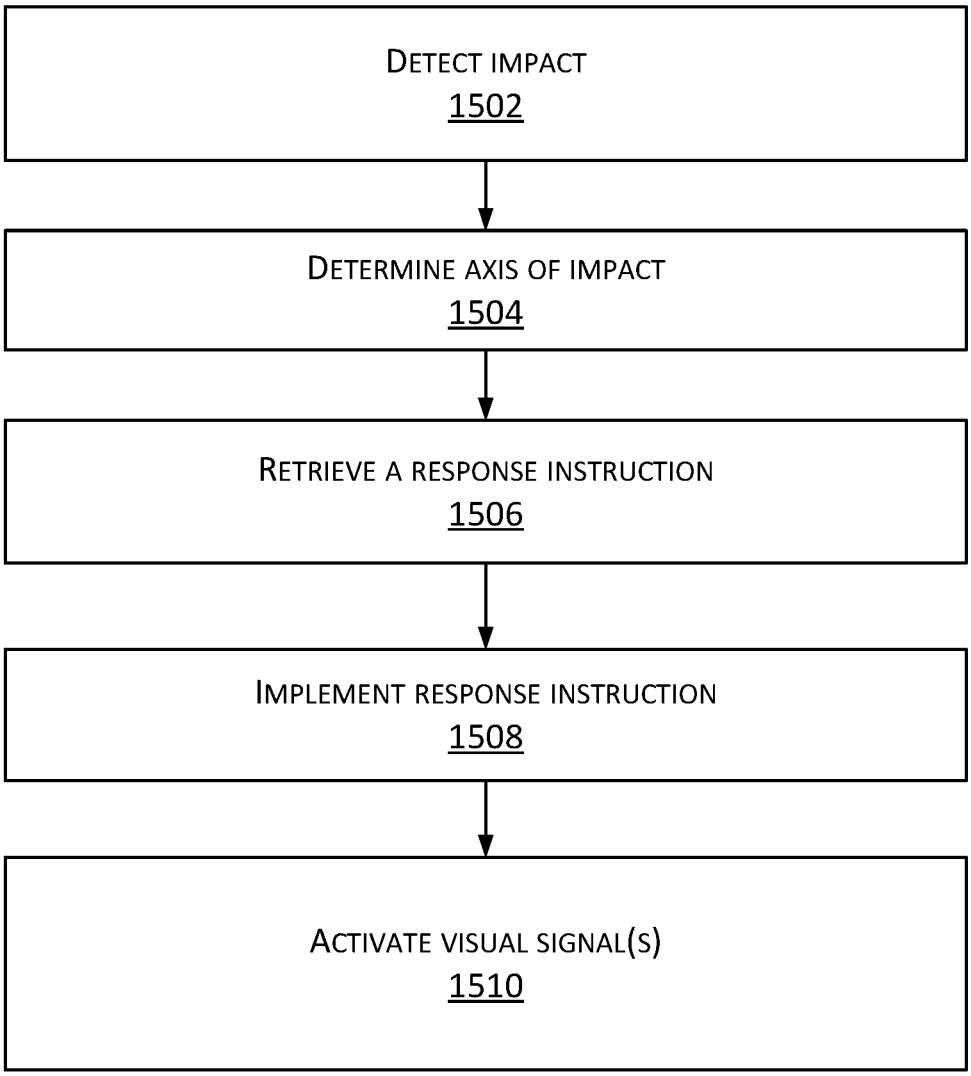
FIG. 15. Is a flow chart of a method for detecting and signaling a projectile impact according to some embodiments.

FIG. 15 is a flowchart showing an example method for detecting and signaling a strike on a target, according to some embodiments. At step 1502, an impact is detected, for example by an impact sensing unit as described herein. In other embodiments, for example, a near-miss may be detected at step 1502. At step 1504, the axis of the impact is detected or calculated. For example, the impact sensor or an associated computing system may be configured to determine the axis of impact as described in more detail above.

At step 1506, a response instruction corresponding to the type of impact (or near miss) detected is retrieved. For example, a computing system or processor associated with the impact sensor may retrieve a response instruction from a memory, as described in detail above. At step 1508, the response instruction may be processed and/or implemented. For example, the instruction may require data logging, signaling, or various communications to be implemented according to the type of strike detected.

At optional step 1510, a signal may be activated in response to the response instruction. For example, various combinations of LED lights or sequences may be activated to indicate a strike, the type of strike, a near miss, or other outcome of an impact whether a shot on the strike face of a target or as a user command input to configure or modify the operation as a confirmation signal to the user, as described in further detail above.

Various features and advantages of the disclosure are set forth in the following claims.

What is claimed is:

1. An impact sensing system engagable with a target and adapted to detect at least an impact of a projectile on or through the target, the impact sensing system comprising:

a housing;

an impact sensor for sensing an impact along at least a first axis and a second axis; and a computing device including at least one processor and a memory, the computing device in electronic communication with the impact sensor;

wherein the impact sensor is capable of sensing an impact along a second axis; and wherein the memory comprises program instructions executable by the at least one processor of the computing device to:

retrieve a first response instruction from the memory based on the sensed impact;

responsive to sensing the impact, determine whether the impact occurred along the first axis or the second axis; and responsive to determining whether the impact occurred along the first axis or the second axis, retrieve a second response instruction from the memory based on the axis corresponding to the sensed impact.

2. The impact sensing system of claim 1, wherein the impact sensor is a g-force sensor.

3. The impact sensing system of claim 1, further comprising a battery positioned within the housing, wherein the housing includes heating elements powerable by the battery for heating the housing.

4. The impact sensing system of claim 3, wherein the heating elements are configured to engage heating elements configured to heat the target.

5. The impact sensing system of claim 1, wherein the computing device is a first computing device, and further comprising a signal unit in electronic communication with the impact sensing unit, the signal unit including a second computing device including a one processor, a memory, and a signal output device, and wherein the memory of the first computing device comprises program instructions executable by the at least one processor of the first computing device to, responsive to retrieving a first or second response instruction, transmit a communication signal to the second computing device, and wherein the memory of the second computing device comprises program instructions executable by the at least one processor of the second computing device to, responsive receiving the communication signal, command the signal output device to output a signal indicative of the impact.

6. The impact sensing system of claim 5, wherein the signal device includes at least one LED.

7. The impact sensing system of claim 1, wherein the first axis is responsive to a first magnitude or frequency or both of impact and the second axis is responsive to a second magnitude or frequency or both of impact different than the first magnitude or frequency or both of impact.

8. The impact sensing system of claim 7, wherein the impact sensed along the first axis is the impact of the projectile with the target.

9. The impact sensing system of claim 7, wherein the impact sensed on the second axis is an impact to the housing by an operator.

10. The impact sensing system, of claim 1, further comprising a communication device capable of sending and receiving electronic communications utilizing a digital protocol.

11. An impact indication system for indicating an impact of a projectile on a target, the impact indication system comprising:

an impact sensing system including a g-force sensor, a housing engagable with the target system, and a first computing device including a least a processor and a memory; and a signal unit including a housing, a signal output device, a second computing device including a processor and a memory, the first computing device operable to send a signal to the second computing device in response to sensing the impact, and the second computing device operable to produce a signal indicative of the impact;

wherein the impact sensor is capable of sensing an impact along a second axis; and wherein the memory comprises program instructions executable by the at least one processor of the computing device to:

responsive to sensing the impact, determine whether the impact occurred along the first axis or the second axis; and responsive to determining whether the impact occurred along the first axis or the second axis, retrieve a response instruction from the memory based on the axis corresponding to the sensed impact.

12. The impact indication system of claim 11, wherein the signal indicative of the impact is perceptible at least 3,000 feet away from a location of the target.

13. The impact indication system of claim 11, wherein the signal indicative of the impact comprises light and the signal output device includes at least one LED.

14. The impact indication system of claim 11, wherein the first computing device and the second computing device communicate wirelessly via a radio signal utilizing a digital protocol.

15. The impact indication system of claim 11, wherein the first computing device and the second computing device are in communication via a wireless network.

16. The impact indication system of claim 11, further comprising a third computing device including at least one processor and a memory, the third computing device in electronic communication with the signal unit, and wherein the memory of the third computing device includes program instructions executable in response to a signal sent by the signal unit.

17. The impact indication system of claim 16, wherein the signal sent by the signal unit includes information about the impact and a record of the impact is stored in the memory of the third computing device.

18. The impact indication system of claim 11, wherein the signal unit is a first signal unit, and further comprising a second signal output unit including a second signal output device, a third computing device including at least a processor and a memory, and wherein the memory of the third computing device comprises program instructions executable by the at least one processor of the third computing device to:

identify the impact signal; and responsive to identifying the impact signal, send an output signal to the second signal unit including command instructions for outputting a signal.

19. An impact indication system for indicating an impact of a projectile on a target, the impact indication system comprising:

an impact sensor including a g-force sensor, a housing engagable with the target, and a first computing device including at least a processor and a memory; and a signal unit including a housing, a signal output device including a plurality of LEDs, a second computing device including a processor and a memory, the first computing device operable to send a signal indicative of the impact to the second computing device, and the second computing device operable to command the plurality of LEDs to produce a light signal indicative of the impact;

wherein the impact sensor is a first impact sensor, and wherein the impact indication system further comprising a second impact sensor including an audio sensor and a third computing device including a processor and a memory including a database of acoustic profiles, and wherein the third computing device is configured to differentiate between an acoustic profile indicative of an impact of the projectile on the target and an acoustic profile indicative of the projectile missing the target.

20. The impact indication system of claim 19, wherein the housing is generally hexagonal, and wherein one or more of the plurality of LEDs is positioned at a corner of the housing.

* * * * *